US006772751B2

(12) United States Patent
Deuringer et al.

(10) Patent No.: US 6,772,751 B2
(45) Date of Patent: Aug. 10, 2004

(54) APPARATUS AND METHOD FOR CLEANING A COOKING DEVICE

(75) Inventors: Martin Deuringer, Weil (DE); Hubert Brunner, Weil (DE); Elmar Junker, Germering (DE); Manfred Breunig, Augsburg (DE); Michael Herner, Dachau (DE); Judith Imgram, Landsberg (DE); Peter Wiedemann, Klosterlechfeld (DE)

(73) Assignee: Rational AG, Landsberg (DE)

( * ) Notice: Subject to any disclaimer, the term of this patent is extended or adjusted under 35 U.S.C. 154(b) by 37 days.

(21) Appl. No.: 10/258,673

(22) PCT Filed: Feb. 26, 2002

(86) PCT No.: PCT/EP02/02063

§ 371 (c)(1),
(2), (4) Date: Oct. 25, 2002

(87) PCT Pub. No.: WO02/068876

PCT Pub. Date: Sep. 6, 2002

(65) Prior Publication Data

US 2003/0145847 A1 Aug. 7, 2003

(30) Foreign Application Priority Data

Feb. 26, 2001 (DE) ..... 101 09 247

(51) Int. Cl.[7] ..... F24C 14/00

(52) U.S. Cl. ..... 126/20; 126/369; 219/401; 134/22.18

(58) Field of Search ..... 126/20, 20.1, 20.2, 126/369, 369.2, 369.3; 219/401, 201; 134/22.18

(56) References Cited

U.S. PATENT DOCUMENTS 5,368,008 A * 11/1994 Oslin ..... 126/20.2
5,640,946 A * 6/1997 Oslin ..... 126/20
6,410,890 B1 6/2002 Kohlstrung

FOREIGN PATENT DOCUMENTS

| | | |
|---|---|---|
| DE | 36 09 115 | 6/1987 |
| DE | 32 15 812 | 1/1988 |
| DE | 197 30 610 | 10/1998 |
| DE | 199 61 835 | 7/2001 |
| DE | 100 17 966 | 10/2001 |
| DE | 198 38 864 | 12/2001 |
| DE | 199 50 649 | 2/2002 |
| EP | 0 092 851 | 8/1989 |

OTHER PUBLICATIONS

Publication No. US 2001/0011549 A1, Publication Date Aug. 9, 2001, *U.S. patent application Publication.*

* cited by examiner

*Primary Examiner*—Jiping Lu
(74) *Attorney, Agent, or Firm*—Schiff Hardin LLP

(57) ABSTRACT

A cooking appliance includes a heater, a blower, a steam generator, a cooking chamber, a cooking chamber drain, a steam condenser and a cooking appliance drain, and the steam condenser is arranged between the cooking chamber drain and the cooking appliance drain. A fluid from the steam generator and from a washing liquid reservoir, which fluid includes water, a cleaning agent, a rinsing agent, a wetting agent, a decalcification agent and/or waste products arising when cooking a product in the cooking chamber can be distributed in the cooking chamber for the cleaning of the chamber. A washing liquid reservoir is preferably filled at least partially by a step-by-step method of at least partial over-filling of the steam generator with water, and the washing liquid from the washing liquid reservoir, which liquid includes water and a cleaning agent, a rinsing agent, a wetting agent, a decalcification agent and/or waste products arising when cooking a product in the cooking chamber, is circulated via the blower, which is preferably controlled and/or regulated.

49 Claims, 2 Drawing Sheets

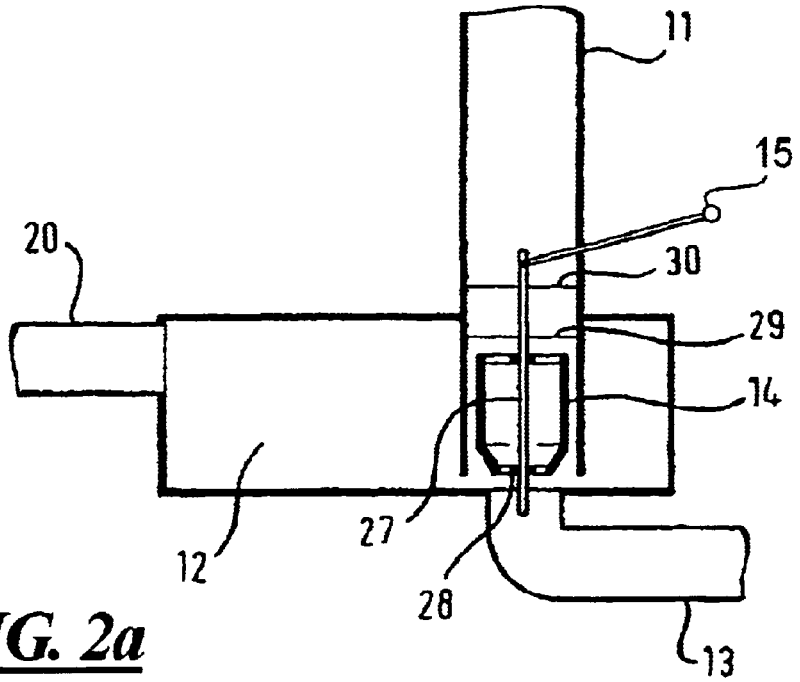
FIG. 2a
FIG. 2b
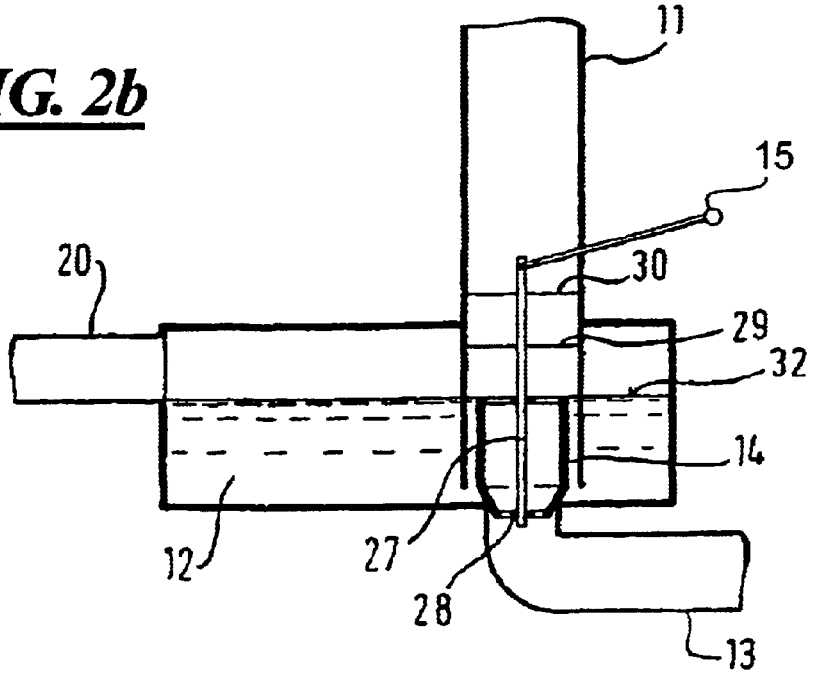

APPARATUS AND METHOD FOR CLEANING A COOKING DEVICE

BACKGROUND OF THE INVENTION

The invention is directed to an apparatus and to a method for cleaning a cooking device or appliance, which device comprises a heater, a blower, a steam generator, a cooking chamber, a cooking chamber drain, a steam condenser and a cooking appliance drain, whereby the steam condenser is arranged between the cooking chamber drain and the cooking appliance drain.

DE 198 38 864, for example, discloses an apparatus for cleaning a cooking chamber, whereby at least one spray nozzle can be arranged in the cooking chamber and also moved around a pivot point therein in addition to a rotary motion so that it has up to three degrees of rotational freedom and so that an optimum spraying of the complete cooking chamber as well as rails or the like potentially arranged in the cooking chamber can occur. To this end, the spray nozzle is to be connected to a traditional water main such as a domestic water supply system upon interposition of a device for preventing a return flow. Additionally, connections can also be provided between the spray nozzle and one or more containers for cleaning agent, wetting agent and/or decalcification agent upon interposition of a respective valve. This apparatus, however, leads to a high consumption of water, cleaning agent, decalcification agent and/or wetting agent, which is disadvantageous because of the limited resources world-wide. The connection to a traditional water main is also disadvantageous since the pressure in such water mains can vary dependent on the installation location.

DE 199 61 835 discloses that considerable resources can be saved when, instead of storage container for cleaning agent, wetting agent, decalcification agent and/or the like, wash water that flows off is at least partly reemployed during the cleaning process. It is thereby especially preferred when highly loaded, dirty water is directly discharged, whereas dirty water that is less highly charged is returned to the cleaning circulation. The control of the cleaning circulation preferably ensues automatically via a specific sensor mechanism.

DE 199 50 649 discloses that a container is detachably secured to the cooking appliance, preferably to the floor of the cooking chamber of the cooking appliance, inside the cooking appliance or outside the cooking appliance or is integrated into the cooking appliance, so that water, wetting agent, cleaning agent, decalcification agent and/or the like is suppliable therefrom in a cleaning process.

DE 100 17 966 discloses a method for cleaning a cooking appliance interior wherein the spray jet of a spray nozzle is arranged against the conveying stream of a blower for the optimum distribution of a fluid during a cleaning process.

DE 197 30 610 C1 discloses a method for cleaning the interior of an oven for the heating of foods, whereby the floor of the oven interior is at least completely covered with a cleaning fluid, and whereby the cleaning fluid is circulated by a circulation device, so that the inside surfaces of the interior are flushed with this cleaning fluid. The oven is equipped with a heater, a blower and a floor drain, whereby cleaning concentrate or wetting agent can be supplied to the interior of the oven via separate containers. Additional water can be supplied into the interior of the oven via an external water connection upon utilization of the conduits for cleaning concentrate and wetting agent.

DE 32 15 812 C2 discloses a cooking appliance particularly provided for foods that has a steam generator into which fresh water is supplied. Via a water-filled U-pipe, the steam generator is in communication with a co-condenser into which the drain from the cooking chamber likewise discharges. A wall divides the co-condenser into a condensation chamber and a drain chamber, whereby the latter has a drain conduit with a drain trap. Over and above this, a further division of the condensation chamber is provided in order to separate the cooking chamber from the drain chamber. The condensation chamber has an additional fresh water admission with whose assistance the grease proceeding into the condensation chamber via the cooking chamber drain can be rinsed out of the co-condenser. Farther-reaching cleaning steps cannot be derived from said Letters Patent.

Despite the numerous efforts in the field of cleaning cooking appliances, there is still always the need to minimize the consumption of water and cleaning chemicals and to simultaneously allow a cleaning program to run with a constant quality independently of the mains water pressure.

SUMMARY OF THE INVENTION

It is therefore an object of the invention to develop the apparatus of the species as well as the method of the species so that the disadvantages of the Prior Art are overcome, particularly in the form of an optimization of the consumption of the water and the cleaning chemicals given a constant cleaning quality regardless of the installation location of a cooking appliance. A further object of the invention is to develop the apparatus of the species as well as the method of the species so that a cleaning quality is assured that is independent of the origin of the cleaning water employed and that always assures faultlessly clean results free of films and residues.

The object directed to the apparatus is inventively achieved in that a fluid obtained by condensing a steam from the steam generator and/or the cooking chamber and/or obtained from a fluid heated at least to a temperature for the precipitation of carbonates and/or obtained from a washing liquid reservoir for a washing liquid comprising water and/or cleaning agent such as at least one cleaner, one rinsing agent, one wetting agent and/or decalcification agent and/or waste products arising when cooking a product in the cooking chamber can be distributed in the cooking chamber for the cleaning of the chamber.

It can thereby be provided that the washing liquid reservoir comprises a quenching box wherein at least one quenching nozzle is arranged via which the washing liquid reservoir can be at least partially fed with a liquid.

A further embodiment is characterized in that the steam generated in the steam generator can be at least partially condensed in the cooking chamber, in the quenching box and/or in the steam condenser.

It is also to be taken into consideration in a preferred development that water that has been heated at least once in the steam generator at least to a temperature for the precipitation of carbonates, preferably boiled at least once, can be supplied to the washing liquid reservoir and/or the quenching box.

It can thereby be provided that water that is preferably heated, particularly heated to a temperature for the precipitation of carbonates, can be supplied from the steam generator to an intake region of the blower.

It is also inventively provided that the washing liquid can be supplied from the washing liquid reservoir to an intake region of the blower.

It can also be inventively provided that water from the steam generator that is preferably heated, and particularly heated to a temperature for the precipitation of carbonates and the washing liquid from the washing liquid reservoir can be supplied to different regions of the blower and preferably to opposite sides of the blower.

Embodiments of the invention are characterized in that an air baffle means for the at least region-by-region separation of the cooking chamber from a blower chamber for the blower. A first conduit for the washing liquid is attached to the air baffle means and is preferably rigidly attached.

The invention also proposes that the air baffle means is movable, and preferably is pivotable, and the first conduit is connectable to a second conduit for the washing liquid, whereby the second conduit is attached to a cooking chamber wall, and is preferably rigidly attached in regions.

It is provided in a further embodiment that the washing liquid and a swathing fluid are at least partly transported in a shared conduit system. The conduit system preferably comprises double lines and/or the first and/or the second line can also be used for the introduction of a swathing or enveloping fluid.

It can also be provided that at least one first pump between the washing liquid reservoir and the cooking chamber is preferably controlled and/or regulated for conveying the washing liquid and/or the swathing fluid.

The invention also proposes that the washing liquid reservoir is connectable to at least one wetting agent reservoir, which is preferably in the form of a drawer or sliding box, and particularly upon interposition of a first valve and/or of a pump, to a cleaner reservoir, which is preferably in the form of a drawer or a sliding box, particularly upon interposition of a second valve and/or of a pump, and/or to a decalcification agent reservoir, which is preferably in the form of a drawer or a sliding box, particularly upon interposition of a third valve and/or of a pump.

It can thereby be provided that the cooking chamber drain and/or the cooking appliance drain can be at least partially closed, particularly mechanically, via a closure element, whereby the closure element preferably comprises a tappet valve, a ball valve, a drain trap, a solenoid, a slide and/or a flap.

It can be likewise provided that the cooking appliance drain can be mechanically closed, preferably via a tappet valve, a ball valve and/or a drain trap.

The invention also proposes that the closure element comprises an overflow opening that, in particular, is spring loaded and/or can be opened above a specific pressure and/or comprises a grease sensor and/or comprises a lipophilic material at least in the region of the overflow opening and preferably includes the inside wall of the overflow opening.

In addition, devices are inventively proposed having a parting element in the cooking appliance drain via which the cooking appliance drain can be divided into at least two lines, whereby greases can preferably be eliminated via one line and essentially grease-free waste water can be eliminated via the other line, preferably in an interactive connection with the overflow opening.

Another embodiment is characterized in that in that the tappet valve is essentially fashioned in the form of a hollow container with sidewalls and a floor, comprising a through opening, whereby the edge regions of the sidewalls preferably form an upper and a lower opening and/or the side walls of the hollow container comprises the form of a hollow cylinder.

It is also to be taken into consideration in a preferred development that the sidewalls of the tappet valve are inwardly beveled in the region of their lower end or of their lower opening.

It can thereby be provided that the tappet valve has an interactive connection, which is preferably movably, to at least one guide element.

It can also be provided that the guide element is resiliently seated, which is particularly by means of a mechanical compression spring, and/or comprises a toothed rack and/or a lifting magnet.

The invention further proposes that the guide element has an interactive connection to a motor that actuates or supports the opening and closing of the tappet valve.

Another embodiment is characterized in that the tappet valve or the sidewalls of the tappet valve can, in particular, be lengthened in a telescoping fashion.

It is also to be taken into consideration in a preferred development that the tappet valve is closeable in a controllable and/or regulatable fashion, particularly with a flap, a cover or a disk, preferably in the region of the upper opening that, in particular, represents the overflow opening.

It can thereby be provided that the tappet valve is implemented curved or angular.

It is also inventively proposed that a vent pipe discharges into the washing liquid reservoir.

It can also be inventively provided that the tappet valve is attached in the washing liquid reservoir in the region of the vent pipe, and particularly below the vent pipe.

Further embodiments of the invention are characterized in that the vent pipe projects into the washing liquid reservoir, and, in the opened condition of the cooking appliance drain, is at least partially accepted by the vent pipe without closing it.

It can thereby be provided that the guide element is in communication with the vent pipe.

In a preferred embodiment, the tappet valve represents an essentially hollow container with side walls whose edge regions fashion an upper and a lower opening, whereby the sidewalls preferably have the form of a hollow cylinder. When the drain opening to be closed by the tappet valve is not located in the floor region but in a sidewall above the floor region, recourse can be had to a curved or angular, particularly right-angled cylinder, particularly a hollow cylinder. A hollow tappet valve represents an overflow safety and—over and above this—enables the amount of maximally available liquid that can be recoursed for the washing liquid to be designationally prescribed via the selection of the height of the tappet valve. By means of a maximum filling without having to fear an uncontrolled overflow and subsequent draining, moreover, an effective self-cleaning of the quenching box or, respectively, of the washing liquid reservoir can be achieved. Without having to fear an uncontrolled overflow or reflux of the liquid collected in the washing liquid reservoir into the cooking chamber, it is also advantageous that slight amounts of liquid, particularly water, can be present in the quenching box or, respectively, washing liquid reservoir, as a result whereof a very effective condensation of vapors deriving from the cooking chamber is assured at the hydraulic seal. In this way, less water, which is required for quenching vapors and fumes, is usually also supplied via quenching nozzles. A connection to the outside can already be produced via the hollow closure when working with a slight over-pressure, for example an overpressure of approximately 1 through 2 mbar.

In another development, the sidewalls of the tappet valve are inwardly beveled in the lower region, particularly in the region of the lower opening. In this way, what is always a dependable closing of the drain opening is achieved regardless of whether the tappet valve has expanded or diminished in size due to temperature or due to some other external influences. The tappet valve can be operated manually or by a lifting and lowering mechanism, whereby a problem-free adjustment or, respectively, insertion is considerably facilitated via at least one guide element with which the tappet valve has an interactive connection, and is movably connected to the guide element. The guide element, for example a rod of, for example, metal or plastic connected to the tappet valve, can be resiliently seated, whereby recourse is particularly had to mechanical compression springs. This is particularly advantageous when the guide element is in communication with a motor that actuates or, respectively, supports the opening and the closing of the tappet valve. The spring-bearing of the guide element or, respectively, of a shaft in communication with the motor particularly protects the motor against damage when contaminants have collected in the drain or, respectively, in the region of the drain.

In another embodiment of the invention, the tappet valve is attached in the region under the vent pipe. The vent pipe can project into the washing liquid reservoir and at least partially accept the tappet valve, particularly in the opened condition, insofar as the valve is conducted upwardly out, whereby the tappet valve does not close the vent pipe by itself because of its size.

Guide elements for the tappet valve can also be employed given this design, and these are preferably in communication with the vent pipe.

The above-described embodiment, wherein a hollow tappet valve that closes a drain is at least partially present in a vent pipe projecting into the washing liquid reservoir or, respectively, into the quenching box, can provide a quasi-closed system with a filling to a height that allows the lower end of the vent pipe to be immersed completely. The quasi-closed system can be maintained at different pressures via the variation of the parameters of the height of the tappet valve, the spacing of the pipe end of the vent pipe from the floor surface of the washing liquid reservoir and the amount of water that is filled in.

Tappet valve as well as vent pipe can be expediently fashioned so that they can be lengthened or shortened, whereby a telescope-like mechanism is especially practical. It is also possible to provide that the drain not be opened in that the tappet valve is moved upward but in that the tappet valve, particularly the hollow tappet valve, is lowered into the drain. In a further development, the hollow tappet valve can be reversibly closed, particularly with a flap, a cover or a disk, preferably in the region of the upper opening.

Preferred embodiments of the invention are characterized by a bulkhead wall in the washing liquid reservoir for the vapor-tight closing of the cooking appliance drain relative to the cooking chamber drain, whereby an exchange of washing liquid via the bulkhead wall is possible.

It can thereby be provided that the bulkhead wall is arranged between the cooking chamber drain and the vent pipe.

In another expedient development, at least one quenching nozzle is attached in the washing liquid reservoir, and the condensation of the entering steam is significantly accelerated with the assistance thereof. At the same time, additional water is made available for the washing liquid reservoir in this way.

It can also be inventively provided that the washing liquid reservoir comprises an overflow line via which waste water flows off only given blockages of the cooking appliance drain, whereby the overflow line is preferably sealed vapor-tight relative to the washing liquid reservoir via an hydraulic seal.

It can thereby be provided that the hydraulic seal is defined by a drain trap.

It is also proposed that a vent pipe discharges into the washing liquid reservoir.

The invention also proposes that the steam generator is connectable to the washing fluid reservoir, particularly via the vent pipe, and preferably with an interposition of a second pump.

It is especially inventively preferred that the washing liquid reservoir is embraced by the steam condenser.

Further developments of the invention can also be characterized by at least one sensing unit for the acquisition of cooking chamber properties such as degree of contamination of the cooking chamber, material of the cooking chamber, temperature in the cooking chamber, degree or air movement in the cooking chamber and/or the like, of cooking appliance operating conditions such as operating mode, operating time, type of product cooked, weight of product cooked, frequency with which the cooking chamber door is opened and/or the like, and/or of washing liquid properties such as degree of contamination, degree of calcification, grease content, hardness and/or the like.

The invention also proposes further developments that are characterized by a control and/or regulating device in an interactive connection with the heater, the blower, the steam generator, the first pump, the second pump, the first valve, the second valve, the third valve, the closure element, the grease sensor and/or the sensing unit.

The object directed to the method is inventively achieved in that a washing liquid reservoir is filled at least partially by means of preferably step-by-step, at least partial over-filling of the steam generator with water and/or by means of at least partial condensation of the steam generated with the steam generator and/or by the product being cooked in the cooking chamber and/or by a fluid from the steam generator and/or from a quenching nozzle that has been particularly heated at least once to at least a temperature for the precipitation of carbonates, which is preferably in the form of water boiled at least once, and the washing liquid from the washing liquid reservoir, comprising water, cleaning agent and/or waste products arising when cooking a product in the cooking chamber, is circulated, and is preferably controlled and/or regulated.

An inventive development of the method is characterized in that the washing liquid is distributed in the cooking chamber via the blower.

In another, preferred embodiment, water from the steam generator that is employed for filling the washing liquid reservoir has been heated at least once to a temperature above 60° C., and particularly above 70° C.

It can thereby be provided that the cooking chamber is heated during distribution of the washing liquid and/or steam is supplied to the cooking chamber via the steam generator.

Further, the invention proposes that water, a cleaning agent comprising at least one cleaner, a wetting agent and/or a decalcification agent are supplied in the washing liquid, and is preferably controlled and/or regulated.

It is inventively preferred that the washing liquid is replenished and/or modified dependent on specific cooking chamber properties such as degree of contamination of the cooking chamber, material of the cooking chamber, temperature in the cooking chamber, degree of air movement in the cooking chamber and/or the like, on specific cooking appliance operating conditions such as operating mode, operating time, type of product cooked, weight of product cooked, frequency of opening the cooking chamber door and/or the like, and/or on specific washing liquid properties such as degree of contamination, hardness and/or the like.

Another embodiment is characterized in that a cleaning agent in the form of a multi-phase cleaning agent is employed, and is preferably in the form of a solid tablet that preferably contains at least a cleaner, a wetting agent and/or a decalcification agent and that can be dissolved in a fluid such as the washing liquid.

It is also to be taken into consideration in a preferred development that the cleaning agent in a bag that can be dissolved in a fluid like the washing liquid and that preferably accepts at least one tablet.

It can thereby be provided that at least one component of the cleaning agent is surrounded by a film that can be dissolved by a fluid like the washing liquid, whereby all components of the cleaning agent are respectively surrounded by a dissolvable film and, in particular, the films are different.

It is also preferred that two or more cleaning agents in solid form are utilized.

It is also inventively proposed that two cleaning agents or two components of a cleaning agent are connected to one another upon interposition of a film.

It can also be inventively provided that the cleaning agent and/or the components of a cleaning agent are fashioned concentrically with one another in a tablet.

It is provided in another embodiment that the speed with which a cleaning agent, a component of a cleaning agent, a bag and/or a film dissolves is selected dependent on the temperature of the washing liquid and/or on the time duration during which the cleaning agent, the bag and/or the film is or, respectively, are subjected to a specific temperature and/or on the pH value of the washing liquid and/or on the quantity of washing liquid and/or on the flow characteristic of the washing liquid and/or on the pressing power of the cleaning agent.

It is also inventively proposed that different cleaners are utilized for different types of dirt such as proteins, sugars, carbohydrates, carbonates, fats or the like.

In addition, a cleaning agent, particularly in a solid dissolvable form, is inventively employed that is a multi-phase or, respectively, a multi-purpose cleaning agent. A wetting agent can also already be potentially contained therein. The components constituting the multi-phase cleaning agent can, for example, be present in a single shaped body, what is referred to as a tablet. It is also possible that one or more cleaning agents, particularly in a solid, dissolvable form, are present in a dissolvable bag that is placed into the cooking appliance to be cleaned, for example into the cooking chamber or into the washing liquid reservoir. The bag dissolves under the cleaning conditions, for example in the presence of the cleaning fluid, and thus releases the cleaning agent or, respectively, agents. Bag materials that dissolve in an aqueous media are known to a person skilled in the art.

It has proven advantageous when, given employment of two or more cleaning agents that are placed in solid form into the appliance to be cleaned, these cleaning agents dissolve at different rates in the presence of a cleaning fluid dependent on the temperature and/or the time duration over which they are subjected to a specific temperature. A multi-step cleaning program can be run in this way even given a one-time addition of the cleaning agents. The employment of different cleaning agents has the advantage that the greatest variety of contaminants, for example fats, sugars or proteins or their decomposition products, can be completely removed in a single cleaning operation. Moreover, a multi-phase cleaning agent can also contain a wetting agent part and thus complete the cleaning system that is present either in the form of tablets or in a bag. Moreover, the cleaning run no longer needs to be interrupted. Especially good cleaning results are achieved when the washing liquid is replaced once or twice during the cleaning process. Further, dirt in the cooking chamber can be incipiently dissolved very well and a cleaning can be considerably improved and accelerated by a targeted generation of steam.

The invention is thus based on the surprising perception for cleaning a cooking appliance that fresh water, particularly from a steam generator, can be filled into a washing liquid reservoir, whether by over-filling of the steam generator, branching off water that has been heated at least once or even boiled, or condensation of vapors, potentially simultaneously with at least one cleaning agent, and the washing liquid is subsequently circulated for the cleaning, namely from the washing liquid reservoir, which is preferably formed by a steam condenser, to the intake side of a blower, through the cooking chamber and cooking chamber drain back into the washing liquid reservoir. Of course, the circulation and composition of the washing liquid, including time duration, temperature, flow rate and the like, can thereby be controlled and/or regulated.

Advantageously, moreover, the conduit system for the washing liquid can also be utilized at least in regions for supplying a swathing or enveloping fluid to the cooking chamber. Moreover, a steam port closure of the cooking appliance drain, an overflow line and/or the cooking chamber and/or the washing liquid reservoir can be closed in a controllable and/or regulatable fashion via a closing element. The closing element can thereby comprise an overflow opening, so that grease floating on the water can be eliminated and separated from the rest of the washing liquid by means of a targeted, slow delivery of fresh water. For a separate elimination, a separating element that eliminates grease from the cooking appliance via a different conduit than other waste water can also be provided in the cooking appliance drain.

As a result of the advantageous employment of solid cleaning agents, particularly in the form of multi-phase tablets, the cleaning sequence need not be interrupted by the introduction or, respectively, replenishing of the cleaning agents. Moreover, multi-phase tablet can be adapted to the cleaning program in terms of their composition and way in which they develop their various functions.

Further features and advantages of the invention derive from the following description wherein exemplary embodiments of the invention are explained in detail by way of example on the basis of a schematic drawing.

BRIEF DESCRIPTION OF THE DRAWINGS

FIGS. 2*a* and 2*b* are partial cross-sectional views for explaining the action of a hollow tappet valve when closing the washing liquid reservoir of FIG. 1.

DESCRIPTION OF THE PREFERRED EMBODIMENTS

Figure 1:
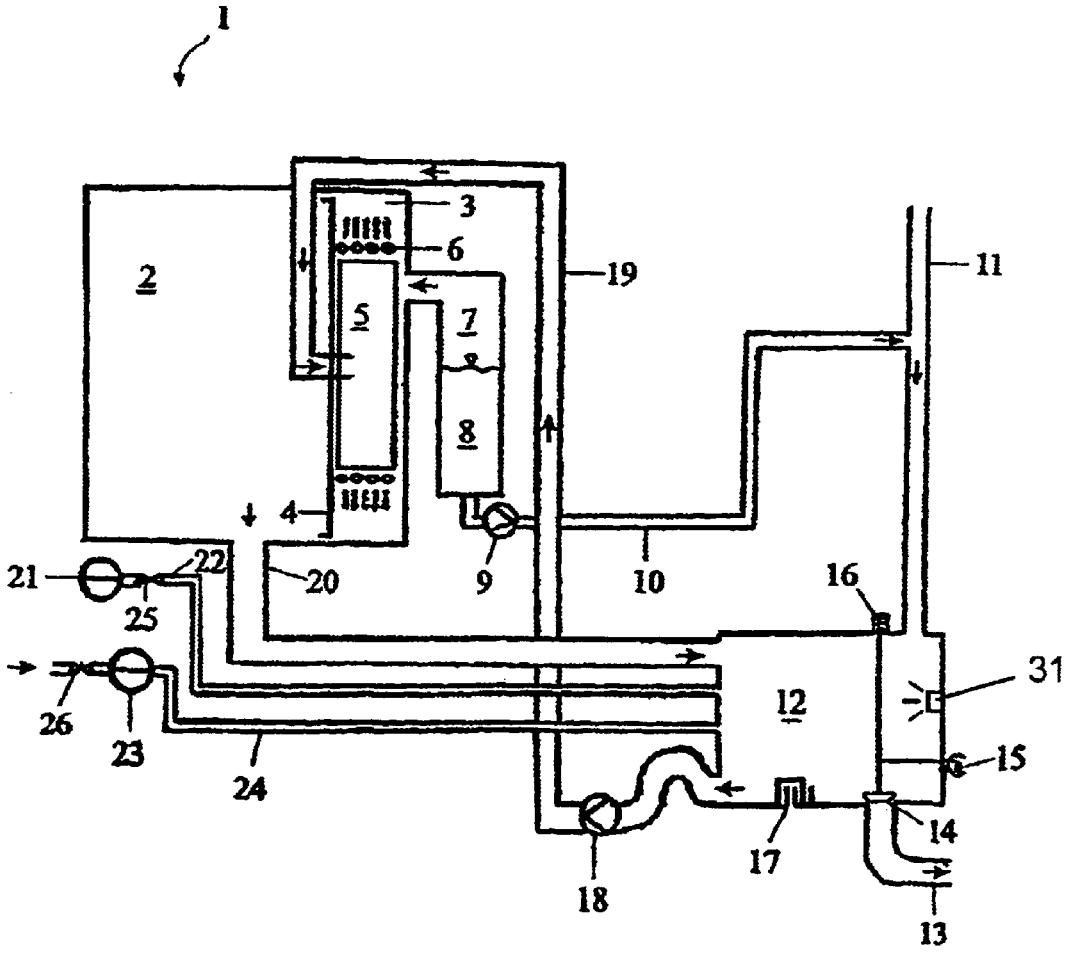
FIG. 1 is a schematic cross-sectional view of a cooking appliance with an inventive apparatus.

The cooking appliance 1 shown in FIG. 1 comprises a cooking chamber 2 and a blower chamber 3 that are separated from one another via an air baffle means or wall 4. A blower 5 and a heater 6 are arranged in the blower chamber 3. Further, a steam generator 7 that is at least partially filled with water 8 discharges into the blower chamber 3. Upon interposition of a pump 9, the steam generator 7 is connected via a conduit 10 to a vent pipe 11 as well as to a quenching box 12 serving as a steam condenser. The quenching box 12 comprises a cooking appliance drain 13 that can be mechanically closed via a tappet valve 14, namely on the basis of the force of a compression spring 16 that can be opposed via a motor 15 with an eccentric for opening the cooking appliance drain 13. The quenching box 12 also comprises a quenching nozzle 31 as well as a drain trap 17 via which a hydraulic seal is offered, particularly for protecting an additional pump 18 from hot fumes. The additional pump 18 is thereby arranged in a conduit 19, which extends from the quenching box 12 into the cooking chamber 2. The cooking chamber 2 is likewise connected to the quenching box 12 via a cooking chamber drain 20. Finally, a wetting agent supply or reservoir 21—via a conduit 22—and a cleaning agent supply or reservoir 23—via a conduit 24—are connected to the quenching box and the flow of these agents are controlled by respective valves 25, 26.

The components of the inventive apparatus described with reference to FIG. 1 can be utilized, for example, in the following way in a cleaning program:

First, the quenching box 12 is closed in that the tappet valve 14 closes the cooking appliance drain 13.

Subsequently, the steam generator 7 is over-filled step-by-step, so that hot water 8 proceeds from the steam generator 7 via the cooking chamber 2 into the quenching box 12.

Subsequently, a pre-wash with water can occur in that the pump 18 and the blower 5 circulate the water from the quenching box 12 via the cooking chamber 2 to the quenching box 12 given the simultaneous application of heat via the heater 6 as well as steam charging via the steam generator 7.

After a specific time of circulation, the washing liquid has become dirty to such an extent that it is replenished. To this end, the cooking appliance drain 13 is briefly opened, so that the washing liquid can flow out, and is subsequently closed in turn in order to at least partially fill the quenching box 12 with hot water 8 from the steam generator 7.

Subsequently, a cleaner can be supplied via the cleaning agent supply or reservoir 23 to the washing liquid, which continues to circulate under the influence of heat and steam.

Particularly dependent on its degree of contamination, the washing liquid can be replenished again during the course of the cleaning process.

A rinse action can occur as soon as the dirt particles have been stripped from the cooking chamber 2. The washing liquid comprises essentially warm water from the steam generator 7 as well as a wetting agent supplied via the wetting agent supply 21.

The cooking chamber 2 can be dried with hot air after the end of the rinse action by draining the washing liquid from the cooking appliance drain 13 after raising the tappet valve 14 against the force of the compression spring 16 by utilizing the motor 15.

FIGS. 2*a* and 2*b* show a tappet valve 14 in the form of a hollow cylinder whose sidewalls taper inwardly in the region of their lower opening facing toward the cooking appliance drain 13 in order to fit an exactly fitting and leak-free closure essentially independently of the degree of expansion or wear of the tappet valve 14 as well as of possible deposits. The hollow tappet valve 14 is in communication with guide elements 27 through 30, so that a faultless closure is assured at any time. For example, the tappet valve 14 can be moved up and down along one of the guide elements 27 either manually or with the assistance of a motor.

Given the position of the tappet valve 14 according to FIG. 2*a*, it is possible to drain the washing liquid from the washing liquid reservoir 12 via the cooking appliance drain 13, whereas the tappet valve 14 in FIG. 2*b* closes the cooking appliance drain 13 until the liquid in the reservoir 12 reaches a maximum liquid level 32. When the washing liquid reservoir 12 is filled beyond the maximum liquid level 32, then the quenching box 12 at least partially empties through the hollow tappet valve 14 via the cooking appliance drain 13 until the level is back at the maximum liquid level 32.

By designationally boosting the washing liquid level within the washing liquid reservoir 12, for example, grease floating on a washing liquid can be eliminated via the cooking appliance drain 13 separated from the remaining washing liquid.

According to the embodiment shown in FIGS. 2*a* and 2*b*, the vent pipe 11 projects into the quenching box 12 and at least partially accepts the hollow tappet valve 14 both in the opened as well as in the closed condition. In this way, a flooding of the cooking chamber 2 or, respectively, a reflux of liquid into the cooking chamber 2 can be dependably prevented and without requiring an additional control. Given brief-duration pressure spikes, the tappet valve 14 beveled in the lower region thereby allows the tappet valve 14 to be raised in order to avoid a sudden overflow. Moreover, briefly occurring pressure fluctuations can be intercepted with the illustrated embodiment.

Further, a large fluid surface is made available at which steam entering into the quenching box 12 is effectively condensed without having to fear that a reflux or back-up will occur given too great a feed of liquid. Moreover, the arrangement of the tappet valve 14 in the vent pipe 11 above the cooking appliance drain 13 sees to a vapor-tight closure of the washing liquid reservoir 12 and, thus, of the cooking chamber 2 to provide a hydraulic seal up to the maximum liquid level 32. This especially serves for minimizing odors.

A cooking in a closed system can also occur in the cooking chamber 2 even when the quenching box 12 is closed in conformity with FIG. 2*b*. A selection can also be made in a simple way between an open and a closed system when cooking, dependent on the demands. When, for example, the tappet valve 14 is in the open position shown in FIG. 2*a*, then the quenching box 12 empties and a hot-air cooking can occur in the cooking chamber. When the tappet valve 14 is in its closing position, as shown in FIG. 2*b*, then a distinction must be made between two versions. When the quenching box 12 is filled with a liquid below the maximum liquid level 32, steam that enters into the quenching box 12 from the cooking chamber 2—which occurs in the case of a steam operation or hot air/steam operation—can condense at the hydraulic seal, which causes an additional quenching and thus saves quenching water. When the pressure in the cooking chamber 2 rises beyond a specific degree, then the tappet valve 14 is lifted from a closure position according to FIG. 2*b* opposite the spring power 16, so that draining via the cooking appliance drain 13 can occur again. When the washing liquid reservoir 12 is filled up to the maximum liquid level 32, then there is also a level of self-cleaning of the quenching box 12.

The closed system has the advantage when steaming that fewer steam losses occur, which also produces a lower energy and water consumption at the same time. The partial pressure in the cooking chamber can be more or less greatly influenced dependent on the matching of the height of the tappet valve 14, of the maximum washing liquid level 32 and of the quantity of liquid actually filled in. The partial pressure needed in the cooking chamber 2 for overcoming the hydraulic seal and, thus, for draining from the washing liquid reservoir 12, namely, is all the higher the higher the filling quantity of the washing liquid reservoir is.

The spring-seating of the tappet valve 14, moreover, serves for protection of the motor 15 in case of contaminants in the cooking appliance drain 13.

Finally, the washing liquid reservoir 12 can also be employed as a reservoir for a swathing or enveloping fluid, whereby the swathing fluid can be distributed in the cooking chamber 2 via the pump 18, the conduit 19 and the blower 5.

Both individually as well as in any arbitrary combination, the features of the invention disclosed in the above specification, in the claims as well as in the drawing can be essential for the realization of the various embodiments of the invention.

We claim:

1. A cooking appliance comprising a heater, a blower, a steam generator, a cooking chamber, a cooking chamber drain, a steam condenser and a cooking appliance drain, with the steam condenser being arranged between the cooking chamber drain and the cooking appliance drain, said appliance including a washing liquid reservoir for receiving water obtained by condensing a steam from the steam generator, water from the cooking chamber and water heated at least to a temperature for the precipitation of carbonates, and combinations thereof, and means for distributing a washing liquid from the washing liquid reservoir into the cooking chamber for cleaning the cooking chamber, said washing liquid including water and an agent selected from a cleaning agent, a rinsing agent, a wetting agent, a decalcification agent and waste products arising when cooking a product in the cooking chamber.

2. A cooking appliance according to claim 1, wherein the washing liquid reservoir comprises a quenching box wherein at least one quenching nozzle is arranged via which a washing liquid reservoir can be partially fed with liquid.

3. A cooking appliance according to claim 1, wherein steam generated by the steam generator can be partially condensed in the cooking chamber, in a quenching box and in a steam condenser.

4. A cooking appliance according to claim 1, wherein water is heated at least once in the steam generator to a temperature for the precipitation of carbonates and is supplied to the washing liquid reservoir and/or a quenching box of the reservoir.

5. A cooking appliance according to claim 1, wherein water is preferably heated to a temperature for the precipitation of carbonates and is supplied from the steam generator to an intake region of the blower.

6. A cooking appliance according to claim 1, wherein the washing liquid can be supplied from the washing liquid reservoir to an intake region of the blower.

7. A cooking appliance according to claim 1, wherein water from the steam generator is preferably heated to a temperature for precipitation of carbonates and the washing liquid from the washing liquid reservoir can be supplied to different regions of the blower.

8. A cooking appliance according to claim 1, which includes an air baffle means for at least a region-by-region separation of the cooking chamber from a blower chamber for the blower, a first conduit for the washing liquid being attached to the air baffle means.

9. A cooking appliance according to claim 8, wherein the air baffle is movable and the first conduit is connectable to a second conduit for the washing liquid, said second conduit being attached to a cooking chamber wall.

10. A cooking appliance according to claim 1, wherein the means for distributing includes a conduit system having double lines.

11. A cooking appliance according to claim 1, wherein the means for distributing includes a first pump between the washing liquid reservoir and the cooking chamber.

12. A cooking appliance according to claim 1, wherein the washing liquid reservoir is connectable to at least one of a wetting agent reservoir having a first valve, a cleaning agent reservoir having a second valve and a decalcification agent reservoir having a third valve.

13. A cooking appliance according to claim 1, wherein at least one of the cooking chamber drain and the cooking appliance drain can be partially closed by a closure element, the closure element being selected from a tappet valve, a ball valve, a drain trap, a solenoid, a slide and a flap.

14. A cooking appliance according to claim 13, wherein the closure element comprises an overflow opening selected from a spring loaded element which can be opened above a specific pressure, a closure element including a grease sensor, and a closure element including a lipophilic material at least in the region of the overflow opening.

15. A cooking appliance according to claim 1, which includes a parting element and the cooking appliance drain so that the cooking appliance drain is divided into at least two lines, so that grease can be eliminated via one line and essentially grease-free waste water can be eliminated via the other line.

16. A cooking appliance according to claim 15, which includes a valve element in the form of a hollow container with sidewalls and a floor, said valve element having a through opening whereby the edge region of the sidewalls forms an upper and a lower opening and the sidewalls of the hollow container comprise the form of a hollow cylinder.

17. A cooking appliance according to claim 16, wherein sidewalls of the valve element are inwardly beveled in the region of the lower end of the lower opening.

18. A cooking appliance according to claim 16, wherein the valve element has an interactive connection to at least one guide element.

19. A cooking appliance according to claim 18, wherein the guide element is resiliently seated by means of a compression spring.

20. A cooking appliance according to claim 18, wherein the guide element has an interactive connection to a motor which actuates the opening and closing of the valve element.

21. A cooking appliance according to claim 16, wherein the sidewalls of the valve element can be lengthened in a telescopic fashion.

22. A cooking appliance according to claim 16, wherein the valve element is closable by a means selected from a flap, a cover and a disk.

23. A cooking appliance according to claim 16, wherein the valve element is implemented curved in an angular fashion.

24. A cooking appliance according to claim 1, which includes a vent pipe discharging into the washing liquid reservoir.

25. A cooking appliance according to claim 24, wherein a valve element is attached in the washing liquid reservoir in the region of the vent pipe.

26. A cooking appliance according to claim 25, wherein the vent pipe projects into the washing liquid reservoir and the valve element, when in an open position, is at least partially received in the vent pipe without closing it.

27. A cooking appliance according to claim 25, wherein a guide element is in communication with the vent pipe.

28. A cooking appliance according to claim 25, wherein the washing liquid reservoir has a bulkhead wall for the vapor-tight closing of the cooking appliance drain relative to the cooking chamber drain, so that an exchange of washing liquid via the bulkhead wall is possible.

29. A cooking appliance according to claim 28, wherein the bulkhead wall is arranged between the cooking chamber drain and the vent pipe.

30. A cooking appliance according to claim 1, wherein the washing liquid reservoir includes an overflow line through which waste water flows out of the reservoir when the cooking appliance drain is closed, said overflow line being sealed vapor-tight relative to the washing liquid reservoir by a hydraulic seal.

31. A cooking appliance according to claim 30, wherein the hydraulic seal for protecting protects a first pump against hot fumes arranged between the washing liquid chamber and the first pump.

32. A cooking appliance according to claim 30, wherein a hydraulic seal is defined by a drain trap.

33. A cooking appliance according to claim 1, wherein the steam generator is connectible to the washing fluid reservoir via a vent pipe having a second pump.

34. A cooking appliance according to claim 1, wherein the washing fluid reservoir embraces a steam condenser.

35. A cooking appliance according to claim 1, which includes at least one sensing unit for the acquisition of cooking chamber properties selected from degree of contamination of the cooking chamber, material of the cooking chamber, temperature in the cooking chamber, degree of air movement in the cooking chamber, cooking appliance operating conditions selected from operating mode, operating time, type of product cooked, weight of product cooked, frequency with which the cooking chamber door is opened and washing liquid properties including degree of contamination, degree of calcification, grease content and hardness.

36. A cooking appliance according to claim 1, which includes a control and regulating arrangement in an interactive connection with a heater, a blower, a steam generator, a first pump, a second pump, a first valve, a second valve and a third valve, a closure element and a grease sensor and a sensing unit.

37. A method for cleaning a cooking appliance having a heater, a blower, a steam generator, a cooking chamber, a cooking chamber drain, a steam condenser and a cooking appliance drain, with the steam condenser being arranged between the cooking chamber drain and the cooking appliance drain, said method comprising filling a washing liquid reservoir at least partially by a step selected from overfilling the steam generator with water, by means of at least partial condensation of the steam generated with the steam generator, the product being cooking in the cooking chamber, by fluids from a steam generator, from a quenching nozzle that has been particularly heated at least once to at least a temperature for precipitating carbonates, water which has been boiled and a washing liquid from a washing liquid reservoir include water, a cleaning agent, waste products arising from the cooking products, and circulating the washing liquid through the appliance.

38. A method according to claim 37, wherein the washing liquid is distributed in the cooking chamber via the blower.

39. A method according to claim 37, wherein the cooking chamber is heated during distribution of the washing liquid and/or steam is applied to the cooking chamber via the steam generator.

40. A method according to claim 37, wherein the water and the cleaning agent having at least one cleaner, a wetting agent and/or a decalcifying agent is supplied to the washing liquid in a controlled manner.

41. A method according to claim 37, which includes replenishing the washing liquid dependent on specific cooking chamber properties, such as the degree of contamination of the cooking chamber, the material of the cooking chamber, the temperature of the cooking chamber, the degree of air movement in the cooking chamber, specific cooking appliance operating conditions selected from operating mode, operating time, type of product cooked, weight of product cooked, frequency of opening the cooking chamber door and the like, and controlling the washing liquid properties including the degree of contamination, and hardness.

42. A method according to claim 37, which includes introducing a cleaning agent in the form of a multi-phase cleaning agent, which includes at least a cleaner and a wetting agent and dissolving the agent in the washing liquid.

43. A method according to claim 37, which includes introducing a bag of the cleaning agent, said bag being dissolved in the fluid of the washing liquid.

44. A method according to claim 37, which includes introducing a cleaning agent containing at least one component surrounded by a film which is dissolvable in a fluid of the washing liquid.

45. A method according to claim 37, which includes utilizing at least two cleaning agents in solid form.

46. A method according to claim 45, wherein the two cleaning agents are connected to one another by a film.

47. A method according to claim 45, wherein the cleaning agents are fashioned concentrically relative to one another in a tablet.

48. A method according to claim 45, wherein the speed of dissolving of the components of the two cleaning agents are of a different time duration with respect to the specific temperature, pH value of the washing liquid and quality of the washing liquid.

49. A method according to claim 45, wherein different cleaners are utilized for different types of dirt selected from proteins, sugars, carbohydrates, carbonates, fats and combustion products thereof.

* * * * *